US008339348B2

(12) United States Patent
Chan et al.

(10) Patent No.: US 8,339,348 B2
(45) Date of Patent: Dec. 25, 2012

(54) LIQUID CRYSTAL DISPLAY AND DRIVING CONTROL CIRCUIT THEREOF

(75) Inventors: Kung-Yi Chan, Hsinchu (TW); Huan-Hsin Li, Hsinchu (TW); Kuo-Hao Fanchiang, Hsinchu (TW); Chun-Kai Huang, Hsinchu (TW)

(73) Assignee: AU Optronics Corp., Hsinchu (TW)

( * ) Notice: Subject to any disclaimer, the term of this patent is extended or adjusted under 35 U.S.C. 154(b) by 930 days.

(21) Appl. No.: 12/144,251

(22) Filed: Jun. 23, 2008

(65) Prior Publication Data

US 2009/0146977 A1 Jun. 11, 2009

(30) Foreign Application Priority Data

Dec. 10, 2007 (TW) ..... 96147004 A

(51) Int. Cl.
*G09G 3/36* (2006.01)

(52) U.S. Cl. ..... 345/98; 345/100

(58) Field of Classification Search ..... 345/87, 345/96, 100, 98
See application file for complete search history.

(56) References Cited

U.S. PATENT DOCUMENTS

2005/0036078 A1 2/2005 Tsunashima et al.
2006/0284811 A1 12/2006 Huang

*Primary Examiner* — Amr Awad
*Assistant Examiner* — Jonathan Boyd
(74) *Attorney, Agent, or Firm* — McClure, Qualey & Rodack, LLP

(57) ABSTRACT

A liquid crystal display device and a driving control circuit thereof are provided. The driving control circuit includes a voltage switch unit and a selection unit. The selection unit selects the voltages in accordance with the control signal, while the voltage switch unit outputs the selected voltage to the common terminal of pixels according to the corresponding scan signal. The driving control circuit, controlled by the control signal and the scan signal, can reduce the modulation frequency and the voltage amplitude, so the power consumption of the liquid crystal display device can be reduced.

15 Claims, 5 Drawing Sheets

LIQUID CRYSTAL DISPLAY AND DRIVING CONTROL CIRCUIT THEREOF

This application claims the benefit from the priority of Taiwan Patent Application No. 096147004 filed on Dec. 10, 2007, the disclosures of which are incorporated by reference herein in their entirety.

CROSS-REFERENCES TO RELATED APPLICATIONS

Not applicable.

BACKGROUND OF THE INVENTION

1. Field of the Invention

The present invention relates to a driving control circuit and a liquid crystal display (LCD) comprising the driving control circuit. More particularly, the present invention relates to a driving circuit for modulating a common voltage and an LCD comprising the driving circuit.

2. Descriptions of the Related Art

FIG. 1 depicts the pixel circuit 1 of a prior art liquid crystal display (LCD). The pixel circuit 1 comprises a thin-film transistor (TFT) 11, a liquid crystal capacitor 12, and a storage capacitor 13. The liquid crystal capacitor 12 and the storage capacitor 13 have a common voltage terminal 121 and 131 respectively to receive a common voltage. The TFT 11 receives a control signal transmitted by a scan line (not shown) via the gate G thereof. When the control signal from the scan line turns on the TFT 11, the data on a data line (not shown) is written into the liquid crystal capacitor 12. Simultaneously, a data voltage is stored in the storage capacitor 13 so that a continued supply of the data voltage is maintained across the liquid crystal capacitor 12 after the TFT 11 is turned off.

Unfortunately, there is a parasitic capacitance 14 between the gate G and the drain D of the TFT 11. Consequently, when the control signal received at the gate G transitions from a positive level to a negative level or vice versa, the voltage difference will be coupled to the storage capacitor 13 and thus, alters the voltage across the storage capacitor 13. This reaction is known as the feed-through effect. Because the feed-through effect tends to cause variation of the voltage stored in the storage capacitor 13, i.e., variation of the data voltage originally written, the display quality of the LCD image may be poor.

As shown in both FIGS. 2A and 2B, FIG. 2A depicts a pixel circuit 2 of the prior art aimed to overcome the feed-through effect, while FIG. 2B depicts the timing diagram of the pixel unit 2 of FIG. 2A. The pixel circuit 2 comprises a TFT 21, a liquid crystal capacitor 22, and a storage capacitor 23; the connections among which are just the same as the counterparts in FIG. 1. In particular, the TFT 21 is coupled to the data line 24, while the liquid crystal capacitor 22 has a common voltage terminal 221 that receives the direct current (DC) common voltage. The storage capacitor 23 has a common voltage terminal 231 that receives an alternating current (AC) common voltage.

In FIG. 2B, G1 represents a scan signal transmitted to the TFT 21, G2 represents a scan signal transmitted to the TFT at the next stage (not shown), VCOM-AC represents a waveform of the VCOM signal supplied to the common voltage terminal 231, and Vd represents the voltage value written into the storage capacitor 23 via the data line 24. Once the scan signal G1 turns on the TFT 21, the voltage value Vd on the voltage line 24 is written into the storage capacitor 23, at which point the VCOM-AC is at a low level. When the scan signal G1 transitions from the high level to the low level, the voltage value Vd is pulled down under the influence of the parasitic capacitance, making it impossible to maintain the written data value. At this time, by transitioning the VCOM-AC from a low level to a high level, the level of the voltage value Vd will be pulled up, thereby mitigating the influence of the feed-through effect.

The pixel circuit 2 overcomes the feed-through effect by modulating the common voltage terminal 231 of the storage capacitor 23, i.e., by maintaining the voltage across the storage capacitor 23 at the originally written data voltage. Specifically, since the storage capacitor 23 has one terminal connected to the common voltage, the differential voltage across the storage capacitor 23 can be controlled by using an AC voltage to drive the common voltage terminal 231 of the storage capacitor 23, i.e., by switching the common voltage, to maintain the voltage value for driving the liquid crystal capacitor 22. Meanwhile, since the AC driving method modulates the voltage in response to data being written, the voltage swing of the data signal may be decreased accordingly. Because the power consumption is in direct proportion to the voltage swing, the decrease in the voltage swing of the data signal may result in the corresponding decrease in power consumption of the whole LCD.

However, because the AC voltage driving method needs to modulate the voltage according to the data signal, an additional driving circuit is needed to modulate the common voltage, thus adding to the cost. Therefore, it is still important to find a new LCD driving method which reduces the cost of manufacturing the driving circuits while still accomplishing the same functions.

SUMMARY OF THE INVENTION

One objective of this invention is to provide a driving control circuit which comprises a first voltage switch unit and a selection unit. The first voltage switch unit is coupled to the first scan line, the second scan line, and a plurality of first pixel units. The first pixel units are disposed at intersections of a plurality of data lines and the first scan line. The first voltage switch unit is configured to transmit one of a first output voltage and a second output voltage to the first pixel units according to a control signal, the first scan signal provided by the first scan line and the second scan signal provided by the second scan line. The selection unit, which is coupled to the first voltage switch unit, is configured to output the first output voltage and the second output voltage to the first voltage switch unit according to the control signal.

Another objective of this invention is to provide a liquid crystal display comprising at least one data line, a first scan line, a second scan line, a plurality of first pixel units, and a voltage switch unit. The first scan line is configured to provide a first scan signal, while the second scan line is configured to provide a second scan signal. The plurality of first pixel units are disposed at intersections of the data line and the first scan line. The voltage switch unit is coupled to the first scan line, the second scan line, and the first pixel units. The voltage switch unit is configured to transmit one of a first output voltage and the second output voltage to the first pixel units according to a control signal, the first scan signal, and the second scan signal.

With the aforementioned arrangement, the driving control circuit and the LCD of this invention is capable of obviating the influence of the parasitic capacitance on the displaying quality, saving driving circuit costs, modulating the common voltage and effectively decreasing the power consumption.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

Figure 1:
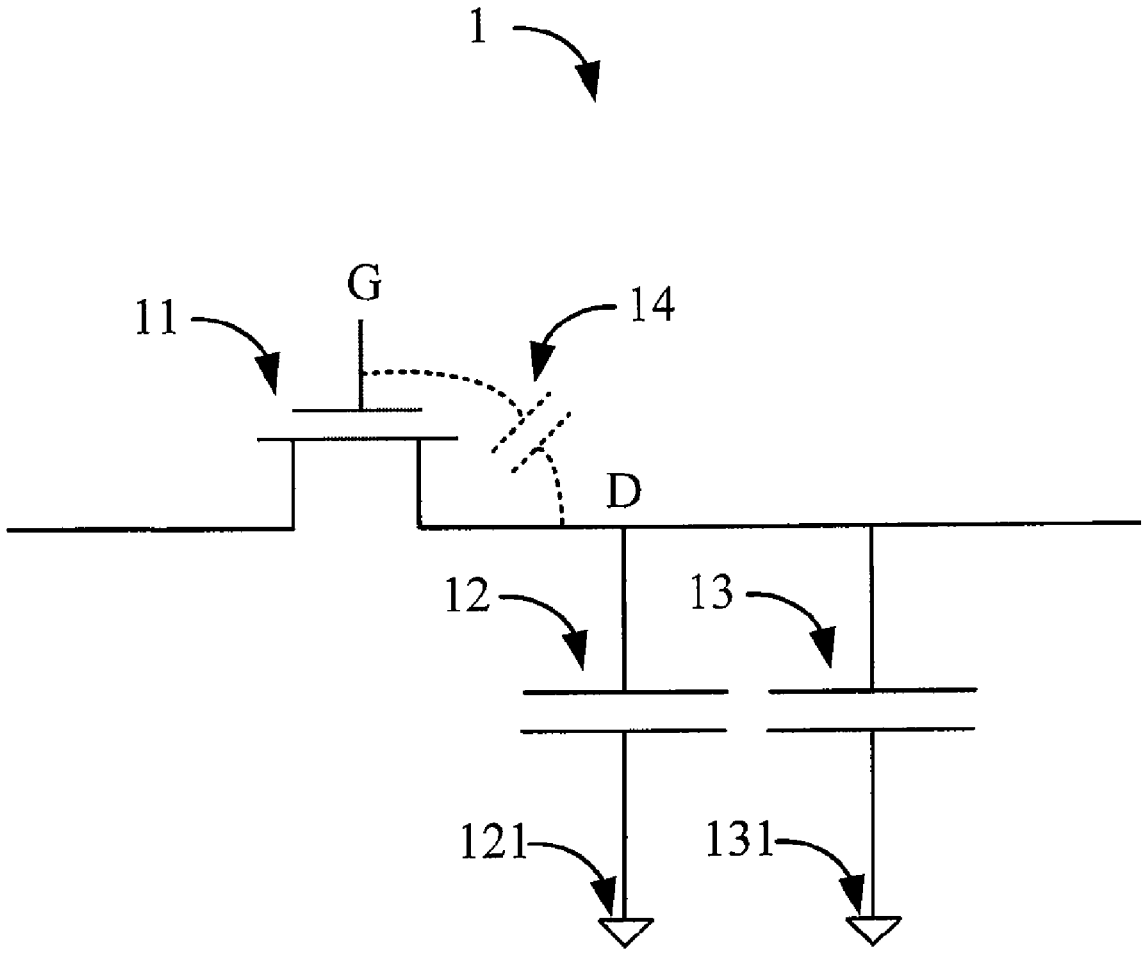
FIG. 1 (Prior Art)
FIG. 1 depicts the pixel circuit of a LCD of the prior art.
Figure 2A:
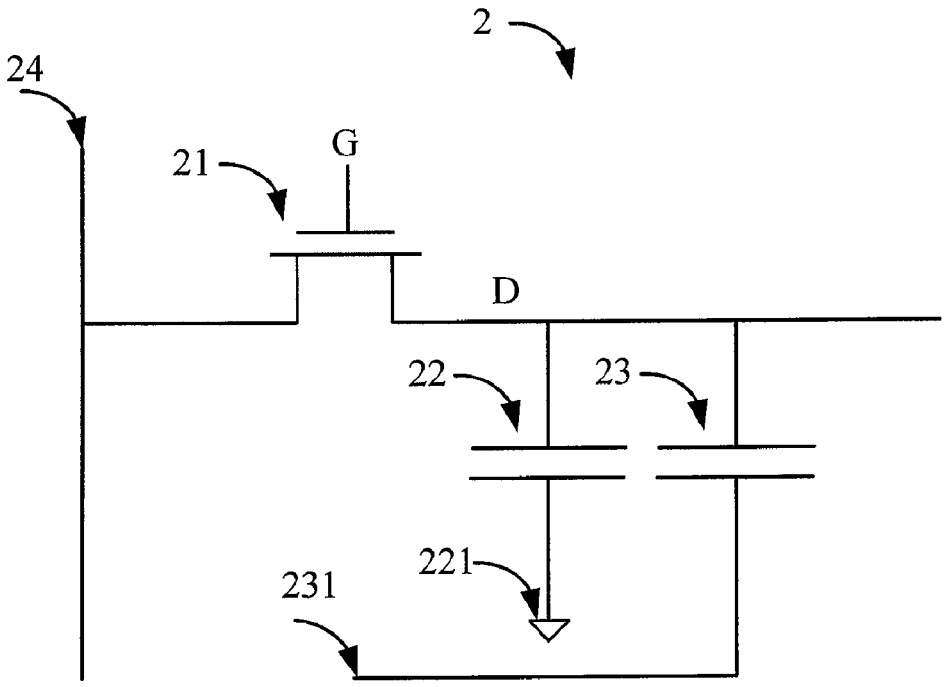
FIG. 2A (Prior Art)
FIG. 2A depicts a pixel structure of the prior art that has a common voltage modulated.
Figure 2B:
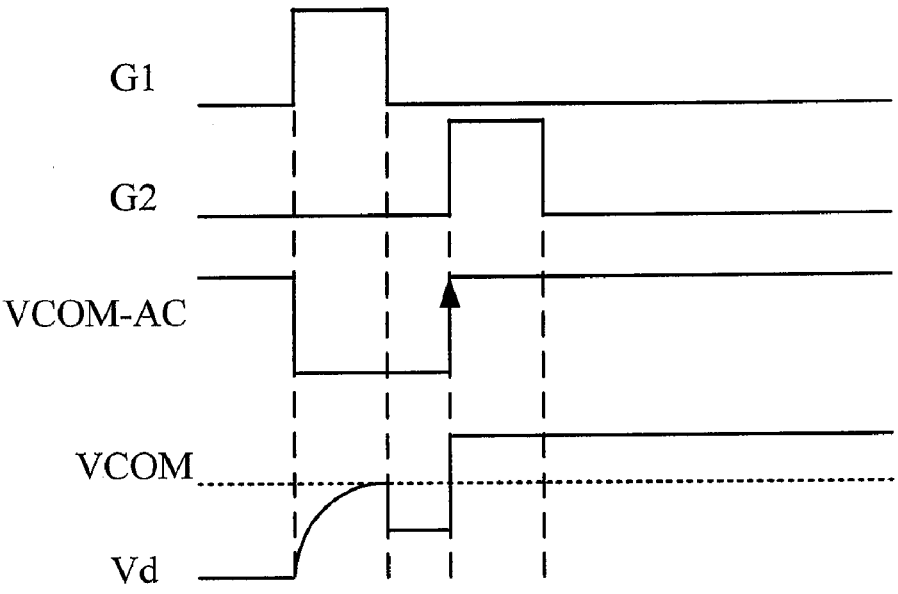
FIG. 2B (Prior Art)
FIG. 2B depicts the timing diagram of the pixel circuit of FIG. 2A.
Figure 3:
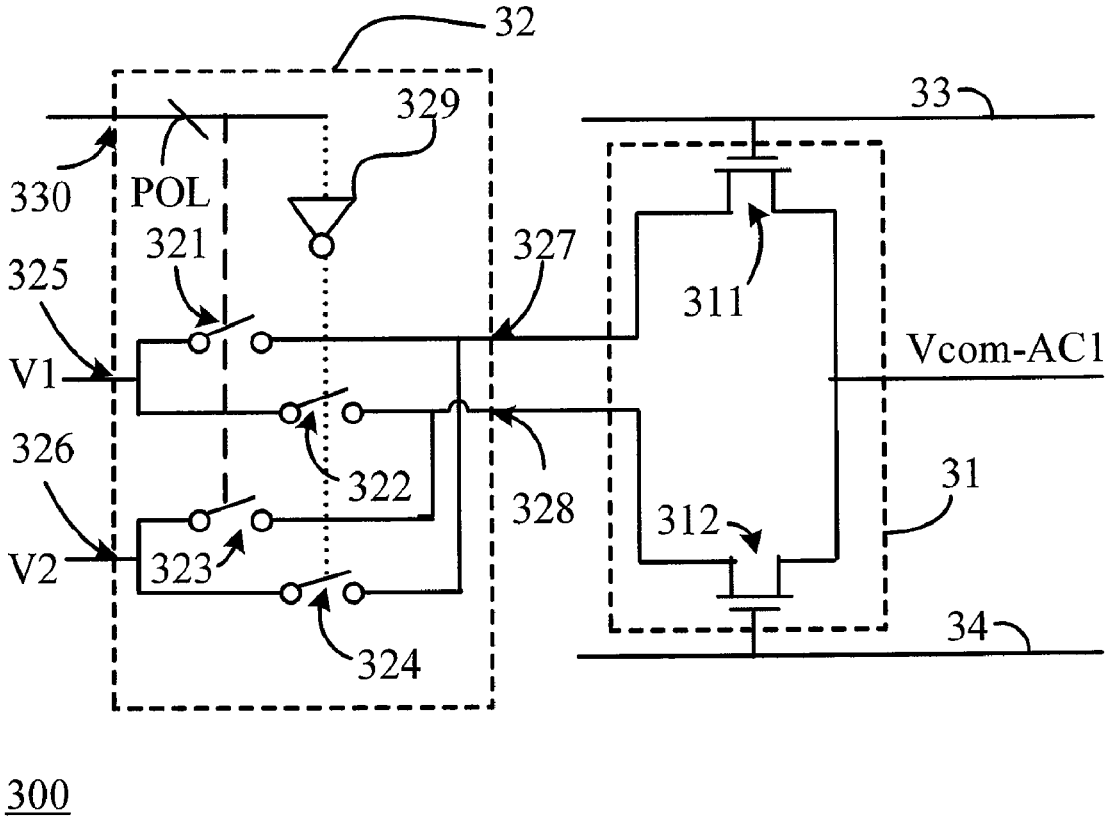
FIG. 3 depicts the driving control circuit of this invention.

As shown in FIG. 3, an embodiment of a driving control circuit of this invention is depicted therein. The driving control circuit 300 is coupled to a first scan line 33, a second scan line 34, and a plurality of first pixel units disposed at intersections between the first scan line 33 and a plurality of data lines. The first scan line 33 provides a first scan signal, while the second scan line 34 provides a second scan signal. The driving control circuit 300 is configured to output an appropriate voltage to the first pixel units according to a control signal.

The driving control circuit 300 comprises a first voltage switch unit 31 and a selection unit 32. The first voltage switch unit 31 is coupled to the first scan line 33, the second scan line 34, and the first pixel units. The selection unit 32, which is coupled to the first voltage switch unit 31, is configured to output a first output voltage and a second output voltage to the first voltage switch unit 31 according to the control signal POL. The first voltage switch unit 31 is configured to transmit either the first output voltage or the second output voltage to the first pixel units according to the control signal, the first scan signal, and the second scan signal.

More specifically, the first voltage switch unit 31 has a first switch 311 and a second switch 312. The first switch 311 has a control terminal, an input terminal, and an output terminal. The control terminal is coupled to the first scan line 33, the output terminal is coupled to a common electrode terminal Vcom-AC1 of each of the first pixel units, and the input terminal is coupled to the selection unit 32 to receive the first output voltage therefrom. The second switch 312 has a control terminal, an input terminal, and an output terminal. The control terminal is coupled to the second scan line 34, the output terminal is coupled to the common electrode terminal Vcom-AC1 of each of the first pixel units, and the input terminal is coupled to the selection unit 32 to receive the second output voltage therefrom. Both the first switch 311 and the second switch 312 may be implemented by a transistor.

The selection unit 32 comprises a control terminal 330, a first input terminal 325, a second input terminal 326, a first output terminal 327, a second output terminal 328, a first selection switch 321, a second selection switch 322, a third selection switch 323, and a fourth selection switch 324. The first output terminal 327 is coupled to the first switch 311, while the second output terminal 328 is coupled to the second switch 312. The first selection switch 321 is coupled to the first input terminal 325 and the first output terminal 327, the second selection switch 322 is coupled to the first input terminal 325 and the second output terminal 328, the third selection switch 323 is coupled to the second input terminal 326 and the second output terminal 328, and the fourth selection switch 324 is coupled to the second input terminal 326 and the first output terminal 327.

The control terminal 330 is configured to receive the control signal POL; the first input terminal 325 is configured to receive a first input signal V1; the second input terminal 326 is configured to receive a second input signal V2. According to the control signal POL, the first output terminal 327 outputs a first output voltage related to one of the first input signal V1, the second input signal V2, and the combination thereof. Likewise, according to the control signal POL, the second output terminal 328 outputs a second output voltage related to one of the first input signal, the second input signal, and the combination thereof.

The first selection switch 321 and the third selection switch 323 are controlled by a first polarity of the control signal POL, while the second selection switch 322 and the fourth selection switch 324 are controlled by a second polarity of the control signal POL. The second polarity is in opposite phase to the first polarity, and is generated from the control signal POL through an inverter 329. In other words, the first selection switch 321 and the third selection switch 323 are turned on in response to the first polarity of the control signal POL to output the first output voltage and the second output voltage respectively. The second selection switch 322 and the fourth selection switch 324 are turned on in response to the second polarity of the control signal POL to output the second output voltage and the first output voltage respectively. Because the first polarity and the second polarity are opposite in phase to each other, the first switch group formed by the first selection switch 321 and the third selection switch 323 will not be turned on simultaneously with the second switch group formed by the second selection switch 322 and the fourth selection switch 324.

When the first switch group (i.e., the first selection switch 321 and the third selection switch 323) is turned on, the first input signal V1 is outputted to the first output terminal 327 while the second input signal V2 is outputted to the second output terminal 328. On the contrary, when the second switch group (i.e., the second selection switch 322 and the fourth selection switch 324) is turned on, the first input signal V1 is outputted to the second output terminal 328 and the second input signal V2 is outputted to the first output terminal 327. Since the selection unit 32 is controlled by the control signal POL, the frame inversion is driven.

Since both the input terminal of the first switch 311 and the input terminal of the second switch 312 of the first voltage switch unit 31 are respectively coupled to the first output terminal 327 and the second output terminal 328 of the selection unit 32 and the selection unit 32 has selected which output terminal (i.e., the first output terminal 327 or the second output terminal 328) the first input signal V1 and the second input signal V2 shall be outputted, the voltage connected to the input terminal of the first switch 311 will be outputted to the common voltage terminal Vcom-AC1 via the output terminal when the first scan signal on the first scan line 33 turns on the first switch 311. Similarly, the voltage connected to the input terminal of the second switch 312 will be outputted to the common voltage terminal Vcom-AC1 via the output terminal when the second scan signal on the second scan line 34 turns on the second switch 312.

In other implementations, the driving control circuit 300 may be further coupled to a third scan line and a plurality of second pixel units disposed at the intersections between the second scan line 34 and the data lines. The third scan line is configured to provide a third scan signal. The driving control circuit 300 is configured to output an appropriate voltage to the second pixel units according to the control signal. The appropriate voltage will be described hereinafter.

The driving control circuit 300 may further comprise a second voltage switch unit, the specific structure of which is just the same as the first voltage switch unit 31. The way in which the second voltage switch unit and the selection unit 32 are coupled is similar to the way in which the first voltage switch unit 31 and the selection unit 32 are coupled, and the way in which the second voltage switch unit and the second pixel units are coupled is also similar to the way in which the first voltage switch unit 31 and the first pixel units are coupled.

In particular, the second voltage switch unit is coupled to the selection unit 32, the second scan line 34, the third scan line and the second pixel units. The second voltage switch unit is configured to output the first output voltage and the second output voltage to the second pixel units according to the control signal POL, the second scan line 34, and the third scan signal provided by the third scan line.

In more detail, the second voltage switch unit comprises a first switch and a second switch. The first switch has a control terminal, an input terminal, and an output terminal. The control unit is coupled to the second scan line 34, the output terminal is coupled to each of the second pixel units, and the input terminal is configured to receive the second output voltage. The second switch has a control terminal, an input terminal, and an output terminal. The control unit is coupled to the third scan line, the output terminal is coupled to each of the second pixel units, and the input terminal is configured to receive the first output voltage.

The second output terminal 328 of the selection unit 32 may be coupled to the first switch of the second voltage switch unit, and is configured to output a second output voltage related to one of the first input signal V1, the second input signal V2, and the combination thereof to each of the second pixel units according to the control signal POL. The first output terminal 327 of the selection unit 32 may be coupled to the second switch of the second voltage switch unit, and is configured to output the first output voltage related to one of the first input signal V1 and the second input signal V2 to each of the second pixel units according to the control signal POL.

With the aforementioned arrangement, an AC driving method for modulating the common voltage terminal is achieved. Because the scan line is driven only once during every frame time period, the operation frequency may be significantly reduced. Moreover, since the voltage of the common terminal can be maintained at a constant level after the scan signal turns off the transistor, a DC driving effect is also obtained, thus reducing the power consumption significantly.

Figure 4:
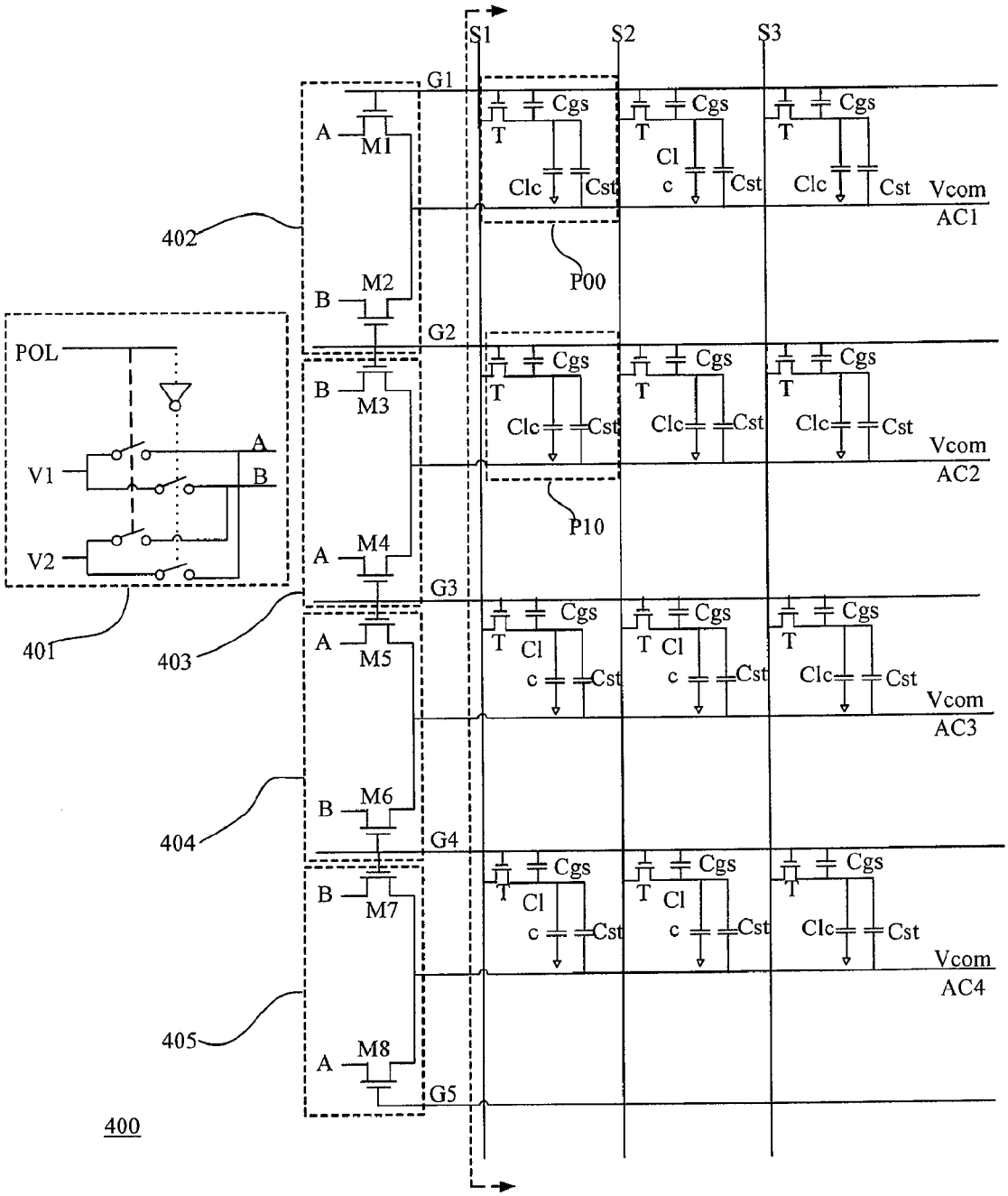
FIG. 4 depicts the LCD of this invention and driving control circuit thereof.

As shown in FIG. 4, an embodiment of an LCD of this invention is depicted therein. The LCD 400 comprises a plurality of data lines (S1, S2, and S3), a plurality of scan lines (G1, G2, G3, G4, and G5), a plurality of pixel units, and a driving control circuit. The scan lines G1, G2, G3, G4, and G5 are denoted in turn as the first scan line G1, second scan line G2, third scan line G3, fourth scan line G4, and fifth scan line G5. The pixel units are disposed at intersections of the data lines S1, S2, S3 and the scan lines G1, G2, G3, G4. More specifically, the first pixel units P00 are disposed at intersections of the data lines S1, S2, S3 and the first scan line G1, the second pixel units P10 are disposed at intersections of the data lines S1, S2, S3 and the second scan line G2, and so on. The first scan line G1 is configured to provide a first scan signal, while the second scan line G2 is configured to provide a second scan signal, and so on. It should be emphasized that the number of scan lines and the data lines are only provided for illustration, rather than to limit the scope of this invention.

Each of the first pixel units P00 comprises a pixel switch T, a pixel capacitor Clc, a first storage capacitor Cst, and a second storage capacitor Cgs. The pixel switch T is coupled to the first scan line G1. The pixel capacitor Clc has a first terminal and a second terminal, in which the first terminal is coupled to the pixel switch T and the second terminal is configured to receive a predetermined voltage. The first storage capacitor Cst has a first terminal and a second terminal, in which the first terminal is coupled to the pixel switch T and the second terminal is coupled to the driving control circuit. The second storage capacitor Cgs has a first terminal and a second terminal, in which the first terminal is coupled to the pixel switch T and the second terminal is coupled to the driving control circuit. However, other implementations may omit the second storage capacitor Cgs in the first pixel units P00 while still achieving the effect of this invention.

Each of the second pixel units P10 also comprises a pixel switch T, a pixel capacitor Clc, and a first storage capacitor Cst. The pixel switch T is coupled to the second scan line G2. The pixel capacitor Clc has a first terminal and a second terminal, in which the first terminal is coupled to the pixel switch T and the second terminal is configured to receive a predetermined voltage. The first storage capacitor Cst has a first terminal and a second terminal, in which the first terminal is coupled to the pixel switch T and the second terminal is coupled to the driving control circuit. The second storage capacitor Cgs has a first terminal and a second terminal, in which the first terminal is coupled to the pixel switch T and the second terminal is coupled to the driving control circuit. Other pixel units are similar in structure to the first and the second pixel units P00, P10 except that they are coupled to different scan lines. However, other implementations may omit the second storage capacitor Cgs in the second pixel units P10 while still achieving the effect of this invention.

The driving control circuit comprises the selection unit 401 and a plurality of voltage switch units 402, 403, 404, 405. The voltage switch units 402~405 are denoted in turn as a first voltage switch unit 402, a second voltage switch unit 403, a third voltage switch unit 404, and a fourth voltage switch unit 405. The voltage switch units 402~405 are the same in structure as the first voltage switch unit 31 of the previous embodiment and thus will not be described again herein. Nevertheless, the couplings of each of the voltage switch units 402~405 with the driving control circuit are not completely the same, and will be described in part hereinbelow.

The driving control circuit (i.e., the selection unit 401 and the voltage switch units 402~405) is disposed in the non-display region of the LCD 400. The voltage switch units 402~405 are interposed between every two adjacent scan lines respectively. For example, the first voltage switch unit 402 is interposed between and coupled with the first scan line G1 and the second scan line G2, the second voltage switch unit 403 is interposed between and coupled with the second scan line G2 and the third scan line G3, and so on. The first voltage switch unit 402 may be coupled to the first pixel units P00, while the second voltage switch unit 403 may be coupled to the second pixel units P10, and so on.

The driving control circuit transmits one of the first output voltage and the second output voltage to the first pixel units P00 according to the control signal POL, the first scan signal and the second scan signal. The driving control circuit supplies one of the first output voltage and the second output voltage to the second pixel units P10 according to the control signal POL, the second scan signal and the third scan signal. The specific way to accomplish this will be described in the following paragraphs.

The selection unit 401 of the driving control circuit is disposed separately. The selection unit 401 is the same in structure as the selection unit 32 of the previous embodiment and thus will not be described again herein. It should be noted that the first output terminal A and the second output terminal B of the selection unit 401 are connected with the voltage switch units 402~405 in an interlaced manner. For example, the input terminal of the first switch M1 of the first voltage switch unit 402 is coupled to the first output terminal A of the selection unit 401, while the input terminal of the second switch M2 is coupled to the second output terminal B of the selection unit 401; an input terminal of the first switch M3 of the second voltage switch unit 403 is coupled to the second output terminal B of the selection unit 401, while the input terminal of the second switch M4 is coupled to the first output terminal A of the selection unit 401. Likewise, both the first switch and the second switch of each pixel unit may be implemented respectively by a transistor. By making connections in this order, a line inversion driving method may be accomplished.

Figure 5:
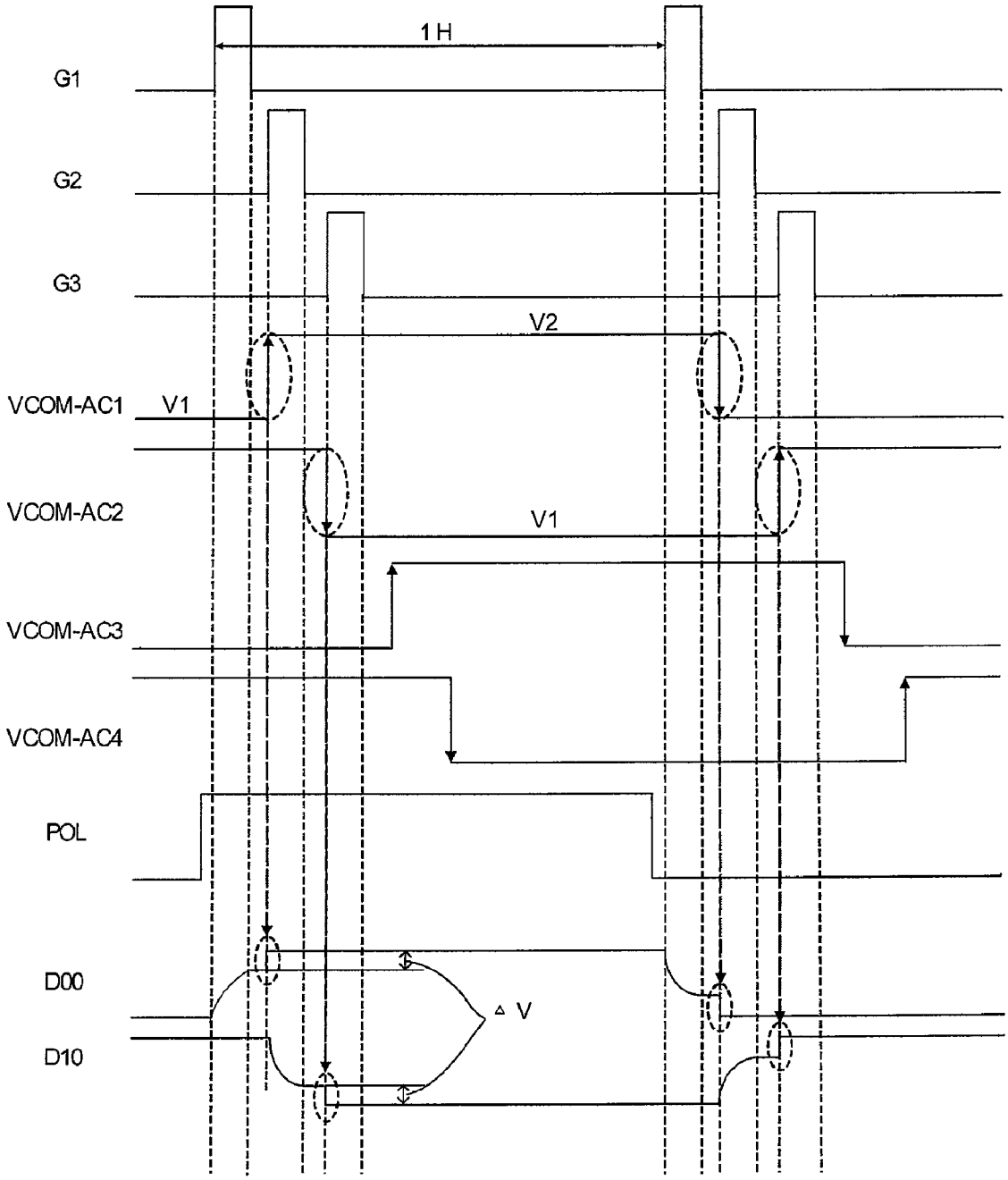
FIG. 5 depicts the timing diagram of relevant signals in an LCD of this invention.

As shown in FIGS. 4 and 5 together, FIG. 5 depicts the relevant timing diagram of the LCD 400. In the following description, the operational principals thereof will be explained. From top to bottom, FIG. 5 depicts the timing diagrams of the scan lines G1, G2, G3, the variation of a voltage on the common voltage terminal Vcom-AC1 of the first pixel units P00, the variation of a voltage on the common voltage terminal Vcom-AC2 of the second pixel units P10, variation of a voltage on the common voltage terminal Vcom-AC3 of the third pixel units, the variation of a voltage on the common voltage terminal Vcom-AC4 of the fourth pixel units, the timing diagram of the control signal POL, a voltage value D00 written into the first pixel units P00, and a voltage value D10 written into the second pixel units P10.

When the first scan line G1 is at a high voltage level, the first switch M1 of the first voltage switch unit 402 is turned on, in which case the first input signal V1 connected to the first switch M1 is outputted to the common voltage terminal Vcom-AC1. Hence, it can be seen that charging of the voltage value D00 written into the pixel units P00 begins and continues until the signal on the first scan line G1 transitions to a low level. In typical designs, a time delay is set between two adjacent scan signals to prevent the simultaneous turning on of multiple scan lines. As a consequence, during this time delay period, the voltage stored in the first storage capacitor Cst of the first pixel unit is maintained.

When the second scan line G2 is at a high voltage level, the second switch M2 of the first voltage switch unit 402 is turned on, in which case the second input signal V2 is outputted to the common voltage terminal Vcom-AC1. Then, through the coupling action of the first storage capacitor Cst, the high level of the second input signal V2 pulls the voltage level stored in the first storage capacitor Cst up by an amount of ΔV (i.e., V2-V1). Consequently, it can be seen that the voltage level stored in the first storage capacitor Cst is eventually increased by ΔV from the original value. In this way, it is possible to compensate for the feed-through effect caused by switching the pixels and weakened consequent variation of the voltage stored in the first storage capacitor Cst, thus improving the image displaying quality.

Similarly, since the second scan line G2 turns on the second switch M2 of the first voltage switch unit 402 and the first switch M3 of the second voltage switch unit 403 simultaneously, the first switch M3 outputs the second output signal V2 to the common voltage terminal Vcom-AC2 of the second pixel units P10. When the third scan line G3 is at a high voltage level, the second switch M4 of the second voltage switch unit 403 is turned on, in which case the first input signal V1 at a low level is outputted to the common voltage terminal Vcom-AC2. When the scan line is at a high voltage level, the first storage capacitor Cst in the second pixel unit P10 is undergoing the discharging process. Since the first storage capacitor Cst of the second pixel unit P10 has one end thereof connected to Vcom-AC2, when the second switch M4 outputs the first output signal V1 of a low level to the common voltage terminal Vcom-AC2, the first input signal V1 will be coupled to the first storage capacitor Cst of the second pixel unit P10, pulling down the voltage value D10 of the first storage capacitor Cst by the amount of ΔV accordingly.

Since the scan line is turned on only once during every frame time period, the common voltage will be maintained at a constant level until the scan line is turned on next time, thus resulting in a DC driving effect. Moreover, when the scan lines are turned on in sequence with the resulting AC driving effect, the voltage level of the data signals and thus the power consumption may be reduced remarkably. Furthermore, since the selection unit 401 is controlled by the control signal POL, the driving effect of frame inversion may be readily achieved.

The above disclosure is related to the detailed technical contents and inventive features thereof. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A driving control circuit for use in a liquid crystal display (LCD), the LCD comprising a plurality of data lines, a first scan line, a second scan line, a third scan line, a plurality of first pixel units, and a plurality of second pixel units, the first scan line being configured to provide a first scan signal, the second scan line being configured to provide a second scan signal, the third scan line being configured to provide a third scan signal, the first pixel units being disposed at intersections of the data lines and the first scan line, the second pixel units being disposed at intersections of the data lines and the second scan line, the driving control circuit comprising:

a first voltage switch unit, being coupled to the first scan line, the second scan line, and the first pixel units, the first voltage switch unit having a first switch and a second switch, the first voltage switch unit being configured to transmit one of a first output voltage and a second output voltage to the first pixel units according to a control signal, the first scan signal, and the second scan signal, wherein the first output voltage is transmitted via the first switch of the first voltage switch unit and the second output voltage is transmitted via the second switch of the first voltage switch unit;

a second voltage switch unit, being coupled to the second scan line, the third scan line, and the second pixel units, the second voltage switch unit being configured to transmit one of the first output voltage and the second output voltage to the second pixel units according to the control signal, the second scan signal, and the third scan signal, wherein the second output voltage is transmitted via a first switch of the second voltage switch unit, the first output voltage is transmitted via a second switch of the second voltage switch unit, and the second scan line turns on the second switch of the first voltage switch unit and the first switch of the second voltage switch unit simultaneously; and a selection unit, having a first output terminal and a second output terminal, the first output terminal being coupled to the first switch of the first voltage switch unit and the second switch of the second voltage switch unit, the second output terminal being coupled to the second switch of the first voltage switch and the first switch of the second voltage switch unit, the selection unit outputting the first output voltage and the second output voltage to the first voltage switch unit and the second voltage switch unit according to the control signal.

2. The driving control circuit of claim 1, wherein the first voltage switch unit comprises:

the first switch having a control terminal, an input terminal, and an output terminal, the control terminal being coupled to the first scan line, the output terminal being coupled to each of the first pixel units, and the input terminal being configured to receive the first output voltage; and the second switch having a control terminal, an input terminal, and an output terminal, the control terminal being coupled to the second scan line, the output terminal being coupled to each of the first pixel units, and the input terminal being configured to receive the second output voltage.

3. The driving control circuit of claim 2, wherein the selection unit comprises:

a control terminal for receiving the control signal;

a first input terminal for receiving a first input signal;

a second input terminal for receiving a second input signal;

the first output terminal coupled to the first switch, being configured to output the first output voltage related to one of the first input signal, the second input signal, and the combination thereof according to the control signal; and the second output terminal coupled to the second switch, being configured to output the second output voltage related to one of the first input signal, the second input signal, and the combination thereof according to the control signal.

4. The driving control circuit of claim 3, wherein the selection unit further comprises:

a first selection switch coupled to the first input terminal and the first output terminal;

a second selection switch coupled to the first input terminal and the second output terminal;

a third selection switch coupled to the second input terminal and the second output terminal; and a fourth selection switch coupled to the second input terminal and the first output terminal;

wherein the first selection switch and the third selection switch are simultaneously on in response to a first polarity of the control signal for respectively outputting the first output voltage and the second output voltage, and the second selection switch and the fourth selection switch are simultaneously on in response to a second polarity of the control signal for respectively outputting the second output voltage and the first output voltage.

5. The driving control circuit of claim 4, wherein the first switch of the second voltage switch unit has a control terminal, an input terminal, and an output terminal, the control terminal being coupled to the second scan line, the output terminal being coupled to each of the second pixel units, and the input terminal being configured to receive the second output voltage; and the second switch of the second voltage switch unit has a control terminal, an input terminal, and an output terminal, the control terminal being coupled to the third scan line, the output terminal being coupled to each of the second pixel units, and the input terminal being configured to receive the first output voltage.

6. The driving control circuit of claim 5, wherein the second output terminal of the selection unit is further coupled to the first switch of the second voltage switch unit for outputting the second output voltage related to one of the first input signal, the second input signal, and the combination thereof to each of the second pixel units according to the control signal, and the first output terminal of the selection unit is further coupled to the second switch of the second voltage switch unit for outputting the first output voltage related to one of the first input signal, the second input signal, and the combination thereof to each of the second pixel units according to the control signal.

7. A liquid crystal display (LCD), comprising:

a plurality of data lines;

a first scan line for providing a first scan signal;

a second scan line for providing a second scan signal;

a third scan line for providing a third scan signal;

a plurality of first pixel units disposed at intersections of the data lines and the first scan line, each of the first pixel units comprising:

a pixel switch coupled to the first scan line;

a pixel capacitor having a first terminal and a second terminal, the first terminal being coupled to the pixel switch, and the second terminal being configured to receive a predetermined voltage;

a first storage capacitor having a first terminal and a second terminal, the first terminal being coupled to the pixel switch, and the second terminal being coupled to the driving control circuit; and a second storage capacitor having a first terminal and a second terminal, the first terminal being coupled to the pixel switch, and the second terminal being coupled to the driving control circuit;

a driving control circuit coupled to the first scan line, the second scan line, and the first pixel units and a plurality of second pixel units, the driving control circuit being configured to transmit one of a first output voltage and a second output voltage to the first pixel units according to a control signal, the first scan signal, and the second scan signal, the driving control circuit being configured to transmit one of the first output voltage and the second output voltage to the second pixel units according to the control signal, the second scan signal, and the third scan signal, the driving control circuit comprising:

a first voltage switch unit, being coupled to the first scan line, the second scan line, and the first pixel units, the first voltage switch unit having a first switch and a second switch, the first voltage switch unit being configured to transmit one of the first output voltage and the second output voltage to the first pixel units according to the control signal, the first scan signal, and the second scan signal, wherein the first output voltage is transmitted via the first switch of the first voltage switch unit and the second output voltage is transmitted via the second switch of the first voltage switch unit;

a second voltage switch unit, being coupled to the second scan line, the third scan line, and the second pixel units, the second voltage switch unit being configured to transmit one of the first output voltage and the second output voltage to the second pixel units according to the control signal, the second scan signal, and the third scan signal, wherein the second output voltage is transmitted via a first switch of the second voltage switch unit, the first output voltage is transmitted via a second switch of the second voltage switch unit, the second scan line turns on the second switch of the first voltage switch unit and the first switch of the second voltage switch unit simultaneously; and a selection unit, having a first output terminal and a second output terminal, the first output terminal being coupled to the first switch of the first voltage switch unit and the second switch of the second voltage switch unit, the second output terminal being coupled to the second switch of the first voltage switch and the first switch of the second voltage switch unit, the selection unit outputting the first output voltage and the second output voltage to the first voltage switch unit and the second voltage switch unit according to the control signal.

8. The LCD of claim 7, wherein the second voltage switch unit of the driving control circuit further comprises:

the first switch having a control terminal, an input terminal, and an output terminal, the control terminal being coupled to the second scan line, the output terminal being coupled to the second terminal of the first storage capacitor of each of the second pixel units, and the input terminal being configured to receive the second output voltage for transmitting the second output voltage to the second terminal of the first storage capacitor of each of the second pixel units through the output terminal; and the second switch having a control terminal, an input terminal, and an output terminal, the control terminal being coupled to the third scan line, the output terminal being coupled to the second terminal of the first storage capacitor of each of the second pixel units, and the input terminal being configured to receive the first output voltage for transmitting the first output voltage to the second terminal of the first storage capacitor of each of the second pixel units through the output terminal.

9. The LCD of claim 8, wherein the second output terminal of the selection unit is further coupled to the first switch of the second voltage switch unit for transmitting the second output voltage related to one of the first input signal, the second input signal, and the combination thereof to the first storage capacitor of each of the second pixel units according to the control signal, and the first output terminal of the selection unit is further coupled to the second switch of the second voltage switch unit for outputting the first output voltage related to one of the first input signal, the second input signal, and the combination thereof to the first storage capacitor of each of the second pixel units according to the control signal.

10. The LCD of claim 7, wherein driving control circuit comprises:

the first voltage switch unit, comprising:

the first switch having a control terminal, an input terminal, and an output terminal, the control terminal being coupled to the first scan line, the output terminal being coupled to the second terminal of each of the first storage capacitors, and the input terminal being configured to receive the first output voltage for transmitting the first output voltage to the second terminal of each of the first storage capacitors through the output terminal; and the second switch having a control terminal, an input terminal, and an output terminal, the control terminal being coupled to the second scan line, the output terminal being coupled to the second terminal of each of the first storage capacitors, and the input terminal being configured to receive the second output voltage for transmitting the second output voltage to the second terminal of each of the first storage capacitors through the output terminal.

11. The LCD of claim 10, wherein the driving control circuit comprises:

the selection unit, comprising:

a control terminal for receiving the control signal;

the first input terminal for receiving a first input signal;

the second input terminal for receiving a second input signal;

a first output terminal coupled to the first switch, being configured to output the first output voltage related to one of the first input signal, the second input signal, and the combination thereof according to the control signal; and a second output terminal coupled to the second switch, being configured to output the second output voltage related to one of the first input signal, the second input signal, and the combination thereof according to the control signal.

12. The LCD of claim 11, wherein the selection unit comprises:

a first selection switch coupled to the first input terminal and the first output terminal;

a second selection switch coupled to the first input terminal and the second output terminal;

a third selection switch coupled to the second input terminal and the second output terminal; and a fourth selection switch coupled to the second input terminal and the first output terminal;

wherein the first selection switch and the third selection switch are on in response to a first polarity of the control signal for respectively outputting the first output voltage and the second output voltage, and the second selection switch and the fourth selection switch are on in response to a second polarity of the control signal for respectively outputting the second output voltage and the first output voltage.

13. The LCD of claim 12, further comprising:

a plurality of second pixel units being disposed at intersections of the data lines and the second scan line, each of the second pixel units comprising:

a pixel switch coupled to the second scan line;

a pixel capacitor having a first terminal and a second terminal, the first terminal being coupled to the pixel switch and the second terminal being configured to receive a predetermined voltage; and a first storage capacitor having a first terminal and a second terminal, the first terminal being coupled to the pixel switch.

14. A driving control circuit for use in a liquid crystal display (LCD), the LCD comprising a plurality of data lines, a first scan line, a second scan line, a third scan line, and a plurality of first pixel units, the first scan line being configured to provide a first scan signal, the second scan line being configured to provide a second scan signal, the third scan line being configured to provide a third scan signal, the first pixel units being disposed at intersections of the data lines and the first scan line, the driving control circuit comprising:

a first voltage switch unit, being coupled to the first scan line, the second scan line and the first pixel units, the first voltage switch unit being configured to transmit one of a first output voltage and a second output voltage to the first pixel units according to a control signal, the first scan signal, and the second scan signal, wherein the first voltage switch unit comprises:

a first switch having a control terminal, an input terminal and an output terminal, the control terminal being coupled to the first scan line, the output terminal being coupled to each of the first pixel units, and the input terminal being configured to receive the first output voltage; and a second switch having a control terminal, an input terminal and an output terminal, the control terminal being coupled to the second scan line, the output terminal being coupled to each of the first pixel units, and the input terminal being configured to receive the second output voltage;

a selection unit, being coupled to the first voltage switch unit, for outputting the first output voltage and the second output voltage to the first voltage switch unit according to the control signal;

a plurality of second pixel units, the second pixel units being disposed at intersections of the data lines and the second scan line; and a second voltage switch unit, being coupled to the selection unit, the second scan line, the third scan line and the second pixel units, the second voltage switch unit being configured to transmit one of the first output voltage and the second output voltage to the second pixel units according to the control signal, the second scan signal and the third scan signal, wherein the second voltage switch unit comprises:

a first switch having a control terminal, an input terminal and an output terminal, the control terminal being coupled to the second scan line, the output terminal being coupled to each of the second pixel units, and the input terminal being configured to receive the second output voltage; and a second switch having a control terminal, an input terminal and an output terminal, the control terminal being coupled to the third scan line, the output terminal being coupled to each of the second pixel units, and the input terminal being configured to receive the first output voltage.

15. The LCD of claim 14, wherein the LCD comprises a fourth scan line, the fourth scan line is configured to provide a fourth scan signal, the driving control circuit comprises:

a plurality of third pixel units, the third pixel units being disposed at intersections of the data lines and the third scan line; and a third voltage switch unit, being coupled to the third scan line, the fourth scan line and the third pixel units, the third voltage switch unit being configured to transmit one of the first output voltage and the second output voltage to the third pixel units according to the control signal, the third scan signal and the fourth scan signal, wherein the first output voltage is transmitted via a first switch of the third voltage switch unit, the second output voltage is transmitted via a second switch of the third voltage switch unit, and the third scan line turns on the second switch of the second voltage switch unit and the first switch of the third voltage switch unit simultaneously.

* * * * *